US005467688A

United States Patent [19]

Maruyama et al.

[11] Patent Number: 5,467,688

[45] **Date of Patent: * Nov. 21, 1995**

[54] OPERATING VALVE DEVICE

[75] Inventors: Jun Maruyama; Koji Yamashita, both of Kawasaki, Japan

[73] Assignee: Kabushiki Kaisha Komatsu Seisakusho, Tokyo, Japan

[ * ] Notice: The portion of the term of this patent subsequent to Jun. 15, 2008, has been disclaimed.

[21] Appl. No.: 509,580

[22] Filed: Mar. 19, 1993

[30] Foreign Application Priority Data

Aug. 16, 1988 [JP] Japan ..... 63-202747
Aug. 16, 1989 [WO] WIPO ..... PCT/JP89/00834

[51] Int. Cl.[6] ..... F15B 11/08; F15B 13/04

[52] U.S. Cl. ..... 91/441; 91/445; 91/447; 91/468

[58] Field of Search ..... 91/28, 30, 33, 91/441, 445, 447, 468; 137/596, 114

[56] References Cited

U.S. PATENT DOCUMENTS 2,897,651 8/1959 Bregenzer ..... 91/447
4,065,010 12/1977 Worback ..... 91/454
4,569,272 2/1986 Taylor et al. ..... 91/445

*Primary Examiner*—F. Daniel Lopez
*Attorney, Agent, or Firm*—Fish & Richardson

[57] ABSTRACT

An operating valve device for supplying fluid under pressure to an actuator comprises: a first hole (3) and a second hole (4) for allowing fluid under pressure supplied by a pump (P) into an inlet port (2) connected with the pump to selectively flow into pressure chambers ($B_1$, $B_2$) defined on both sides of an actuator (B) through outlet ports (6, 7), respectively; a first communication hole (12) and a second communication hole (13) formed coaxially and in opposed relationship with each other so as to allow the first and second holes, respectively, to communicate with a tank port (10); a first valve hole (14) and a second valve hole (15) formed coaxially in the valve body outside and in succession with these communication holes, respectively; a pair of support shafts (16, 16) inserted in these valve holes, respectively, in opposed relationship with each other; vacuum prevention valves (9, 9) each mounted on the leading end portion of each of the support shafts so as to open and shut the communication hole; and check valves (8, 8) each mounted on the axially intermediate portion of each of the support shafts so as to prevent fluid under pressure from flowing through the first and second holes, respectively, into the inlet port. Since the operating valve device has the vacuum prevention valves and the check valves mounted coaxially on the pair of support shafts, the whole operating valve device becomes compact, and fluid leakage can be reduced substantially.

2 Claims, 3 Drawing Sheets

OPERATING VALVE DEVICE

TECHNICAL FIELD OF THE INVENTION

This invention relates to an operating valve device for supplying fluid under pressure into an actuator such as a hydraulic cylinder, a hydraulic motor or the like.

BACKGROUND ART OF THE INVENTION

As a prior art valve device of the kind specified, there is known an operating valve device which includes, as shown in FIG. 1, a main spool 5 for allowing a first hole 3 and a second hole 4, respectively to selectively communicate with an inlet port 2 formed in the valve body 1, and check valves 8 and vacuum prevention valves 9 installed between the first and second holes 3 and 4, respectively, and a first outlet port 6 and a second outlet port 7 connectable with the first and second holes 3 and 4, respectively, the arrangement being made such that when the main spool 5 is moved to the left or to the right in FIG. 1 the inlet port 2 is connected either with the first outlet port 6 or with the second outlet port 7 so as to selectively supply fluid under pressure from a pressurized fluid supply source P into either one of a first chamber $B_1$ or a second chamber $B_2$ of an actuator B, and also a backward flow of fluid under pressure from the first and second chambers 6, 7 into the inlet port 2 can be prevented by the check valves 8, and also fluid under pressure can be drawn by the vacuum prevention valve 9 from a tank port 10 into the first chamber $B_1$ or the second chamber $B_2$ thereby preventing formation of a vacuum therein or depressurization.

Stating in brief, in case the pressure in the first and second chambers $B_1$ and $B_2$ which results from loading F applied to the actuator B (that will be referred to as "loading pressure" hereinbelow) is higher than the pressure of fluid discharged by the pressurized fluid supply source P, there is a risk of fluid under pressure flowing from the actuator B back into the pressurized fluid supply source B, and therefore such backward flow of fluid is prevented by the check valves 8, respectively.

Further, there is a case where the actuator B is moved by a pressure loading F at a speed higher than the value corresponding to the amount of fluid under pressure supplied by the pressurized fluid supply source P. In this case, the chamber on the side of the actuator into which fluid is to be supplied will form a vacuum, and therefore the vacuum prevention valve 9 is then opened to allow the tank port 10 to communicate either with the first outlet port 6 or with the second outlet port 7 so as to draw in fluid under pressure from the fluid tank 11 thereby preventing formation of a vacuum in the chamber.

In such a prior art operating valve device, since the check valves 8 and the vacuum prevention valves 9 are installed in two rows in parallel relationship between the inlet port 2 and the first and second outlet ports 6 and 7, the distance between the inlet port 2 and the first and second outlet ports 6 and 7 becomes long so that the size of the valve body 1 will become large, thus making the whole valve device large-sized.

Further, since the vacuum prevention valves 9 are installed on the side of the outlet ports, in case the valve seat is worn away or foreign matters made ingress therein, fluid under pressure will flow from the tank port 10 into the fluid tank 11 thus increasing fluid leakage and causing such difficulties as failure in holding the actuator B in locked condition or operational delay, etc.

SUMMARY OF THE INVENTION

The present invention has been made in view of the above-mentioned circumstances in the prior art, and has for its object to provide an operating valve device wherein the space occupied by its constitutional element is reduced thereby making the whole valve device compact, and leakage of fluid from vacuum prevention valves can be reduced substantially.

To achieve the above-mentioned object, according to a first aspect of the present invention, there is provided an operating valve device having an inlet port formed in the valve body so as to communicate with a pressurized fluid supply source, a first outlet port and a second outlet port formed in the valve body so as to communicate with pressure chambers, respectively, defined on both sides of an actuator, a first hole and a second hole formed in the valve body at positions on both sides of the inlet port so as to allow the inlet port to communicate with the first and second outlet ports, respectively, and a tank port formed in the valve body between the first and second holes and communicating with a fluid tank, characterized in that it comprises a first communication hole and a second communication hole formed coaxially and in opposed relationship with each other so as to allow the first and second holes, respectively, to communicate with the tank port; a first valve hole and a second valve hole formed coaxially in the valve body outside and in succession with these communication holes, respectively; a pair of support shafts inserted in these valve holes, respectively, in opposed relationship with each other; vacuum prevention valve means each mounted on the leading end portion of each of the support shafts so as to open and shut the communication hole; and check valve means each mounted on the axially intermediate portion of each of the support shafts so as to prevent fluid under pressure from flowing through the first and second holes, respectively, into the inlet port.

To achieve the above-mentioned object, according to a second aspect of the present invention, there is provided an operating valve device comprising: an inlet port formed in the valve body so as to extend from one end face thereof to a substantially intermediate position in a direction substantially at right angles to the one end face and communicating with a pressurized fluid supply source; a first hole and a second hole formed in the valve body on both sides of the inlet port and in substantially parallel relationship with each other; a valve hole formed in the valve body at right angles to the first and second holes and the inlet port so as to allow the first and second holes, respectively, the communicate with the inlet port; a main spool slidably mounted in the valve hole so as to allow either the first hole or the second hole to selectively communicate with the inlet port; a tank port formed in the valve body so as to extend from the other end face thereof to a substantially intermediate position in a direction at right angles to the other end face and communicating with a fluid tank; a first outlet port and a second outlet port formed in the valve body on both sides of the tank port and in substantially parallel relationship and outside the first and second holes, respectively, and connected with pressure chambers, respectively, defined on both sides of an actuator; a first communication hole and a second communication hole formed in the valve body at right angles to the first and second holes and the tank hole and coaxially with each other to allow the first and second holes, respectively, to communicate with the tank port; a first valve hole and a second valve hole formed in the valve body outside and coaxially with the first and second communication holes, respectively, so as to allow the first and second communication holes, respectively, to communicate with the first and second outlet ports, respectively; a pair of support shafts whose base portions being fixedly secured to the outer ends of the first and second valve holes, respectively, so as to be tightly fitted therein, the leading end portions of the support shafts extending into the first and second communication holes, respectively, and being located opposite to each other; check valves each having a valve body slidably mounted on the axially intermediate portion of each of the support shafts and held by a spring into pressure contact with a check valve seat; and vacuum prevention valves each having a valve body slidably mounted on the axially leading end portion of each of the support shafts and held by a spring into pressure contact with a vacuum prevention valve seat.

According to the operating valve device incorporating the above-mentioned aspects, since the check valve body 17 and the vacuum prevention valve body 20 are mounted coaxially on each of the support shafts 16, the distance between the inlet port 2 and the outlet ports 6 and 7 is short so that the size of the valve body 1 can be made small and the whole operating valve device can be made compact, and also since each of the check valves and vacuum prevention valves can be moved independently, thus enhancing the operational reliability of the operating valve.

Further, the check valve body 17 and the vacuum prevention valve body 20 are mounted coaxially and their valve seats are also mounted coaxially. This implies that there are double seats against leakage of fluid on the side of each outlet port, thereby reducing the amount of leakage of fluid, and even if foreign matters made ingress into one of the check valve and the vacuum prevention valve, sealing by the other can be achieved thus enhancing the reliability thereof on leakage prevention against ingress of foreign matters.

The above-mentioned and other objects, aspects and advantages of the present invention will become apparent to those skilled in the art by making reference to the following description and the accompanying drawings in which a preferred embodiment incorporating the principles of the present invention is shown for example only.

DETAILED DESCRIPTION OF PREFERRED EMBODIMENTS

The present invention will now be described in detail below by way of a preferred embodiment with reference to the accompanying drawings.

Figure 1:
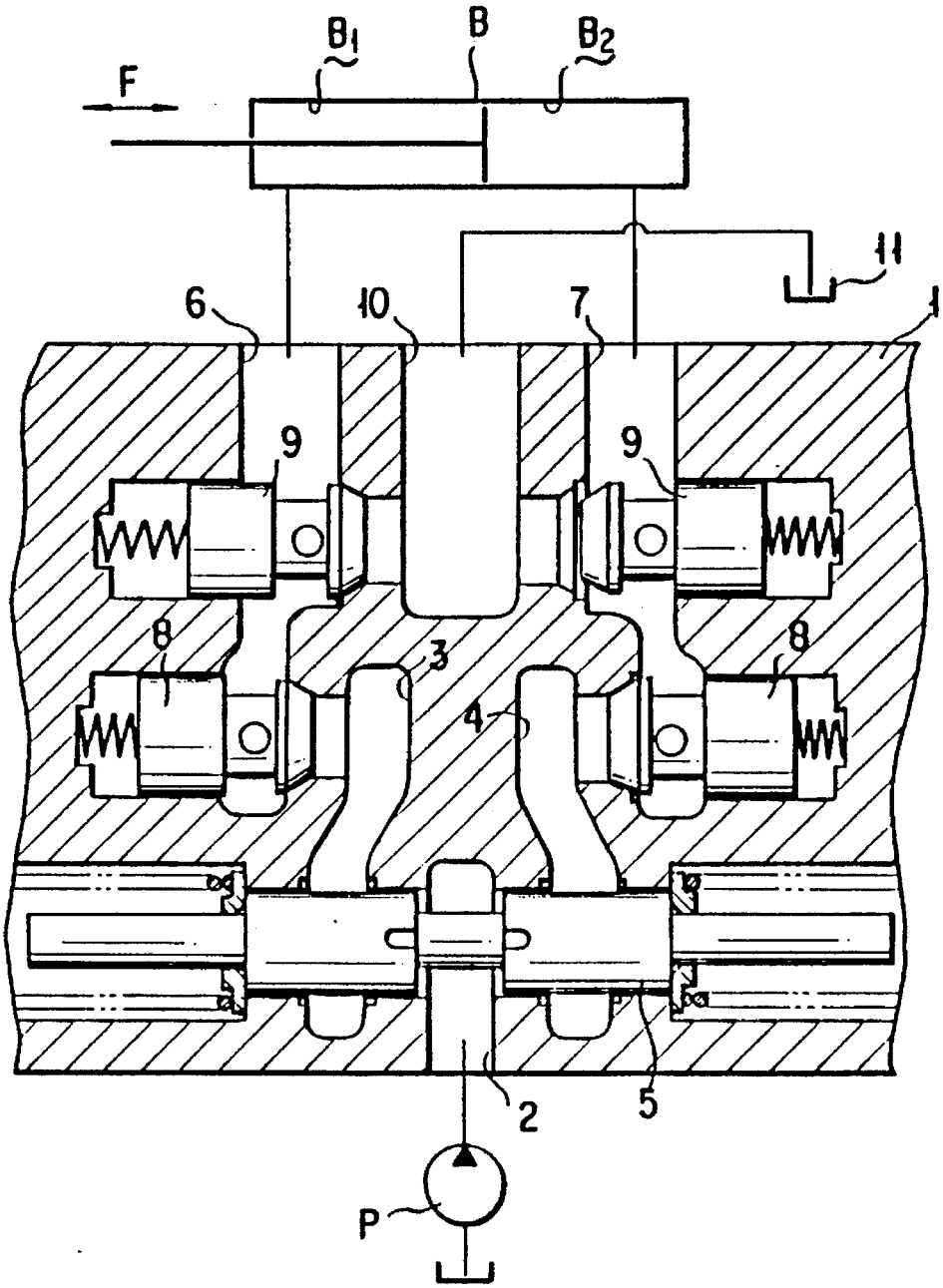
F I G. 1 PRIOR ART
FIG. 1 is a schematic, sectional view showing a prior art embodiment of the operating valve device.
Figure 2:
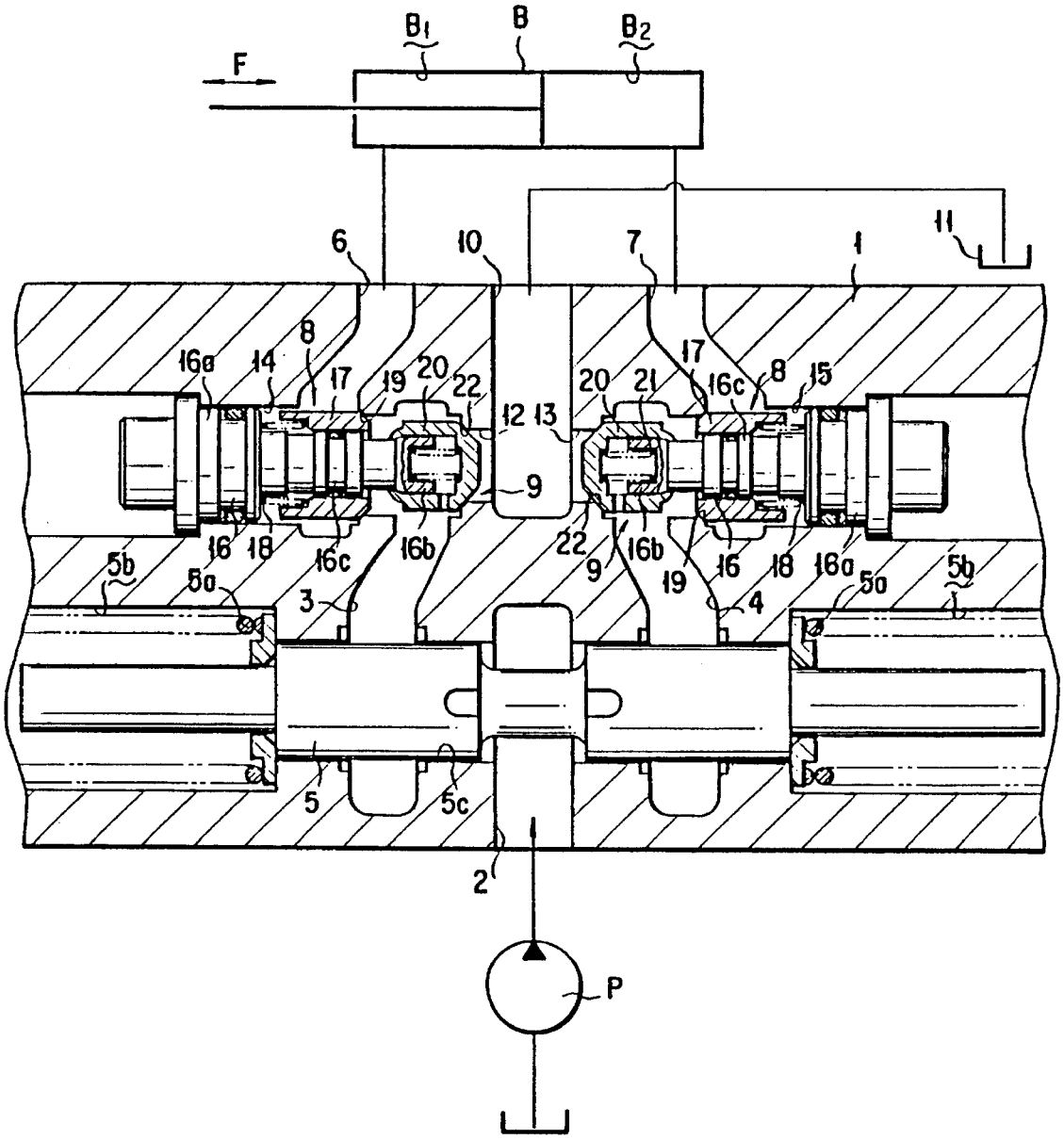
FIG. 2 is a schematic, sectional view showing an embodiment of the operating valve device according to the present invention.

FIG. 2 is a schematic, sectional view showing an embodiment of the operating valve device according to the present invention, where the same component parts as those of the aforementioned embodiment (shown in FIG. 1) are denoted with the same reference numerals and characters, and therefore description of them is omitted herein.

A port 10 connected to a fluid tank is allowed to communicate through coaxial first and second communication holes 12 and 13, which are formed in an intermediate portion interposed between a first port 3 and a second port 4 perforated in a valve body 1 in substantially parallel relationship with each other, with the first and second holes 3 and 4. Further, the valve body 1 has a first outlet port 6 and a second outlet port which are formed therein so as to extend from one end thereof and substantially opposite to the first and second holes 3 and 4, respectively, and which are connected to pressure chambers $B_1$ and B, respectively, of an actuator B. Still further, the valve body 1 has a first valve hole 14 and a second valve hole 15 formed therein outside the first and second outlet ports 6 and 7, respectively, and coaxially with the first and second communication holes 12 and 13, respectively. Support shafts 16, 16 are inserted in the first and second valve holes 14 and 15, respectively. Base portions 16*a*, 16*a* of the support shafts 16, 16 are fixedly secured so as to be tightly fitted in the first and second valve holes 14 and 15, respectively, so that the leading end portions 16*b*, 16*b* of the support shafts 16, 16 extending into the first and second communication holes 12 and 13, respectively, may be located in opposed relationship with each other.

Further, a cylindrical check valve body 17 is slidably mounted on an axial intermediate portion 16*c* of each of the support shafts 16, and the valve body 17 is biased by a spring 18 so as to make pressure contact with a check valve seat 19 thereby forming a check valve 8.

Further, a vacuum prevention valve body 20 is slidably mounted on the leading end portion 16*b* of each of the support shafts 16 so as to prevent either one of the pressure chambers $B_1$ or $B_2$ defined or both sides of the piston of the actuator B from forming a vacuum, and the valve body 20 is biased by a spring 21 so as to make pressure contact with a vacuum prevention valve seat 22, thus forming a vacuum prevention valve 9.

In the operating valve device configured as mentioned above, when the loading pressure in the actuator B is high, the check valve body 17 is urged by the loading pressure so as to make pressure contact with the check valve seat 19 so that a backward flow of fluid under pressure into a pressurized fluid supply source P can be prevented.

Further, if the actuator B is moved at a speed higher than the value corresponding to the amount of fluid under pressure supplied by the pressurized fluid supply source P so as to form a vacuum either in the first chamber $B_1$ or in the second chamber $B_2$, then the check valve body 17 and the vacuum prevention valve body 20 are moved against the resilient forces of the springs 18 and 21, respectively, so as to communicate the tank port 10 either with the first outlet port 6 or with the second outlet port 7 to draw in pressurized fluid from a fluid tank 11 thereby preventing formation of a vacuum in the chamber $B_1$ or $B_2$.

Still further, since the check valve body 17 and the vacuum prevention valve body 20 are slidably mounted coaxially on the support shaft 16, the distance between the inlet port 2 and the outlet ports 6 and 7 can be reduced so that the size of the valve body 1 can be reduced thus making the whole of the valve device compact, and since movements of the check valve body 17 and the vacuum prevention valve body 20 occurs independently, the operational reliability of the operating valve device is enhanced.

Further, since the check valves 8 are located in the outlet ports 6 and 7, respectively, leakage of fluid under pressure from the actuator B can be prevented substantially, and since double sealing is provided by combinations of valve bodies 17 and 20 of the check valve 8 and the vacuum prevention valve 9 with valve seats 19 and 22, respectively, if leakage of fluid occurs in one of the combinations due to foreign matters present therein, then fluid leakage can be prevented by the other combination thereby enhancing the reliability on fluid leakage prevention.

Moreover, the main spool 5 is held at its neutral position by a pair of springs *5a*, *5a* and can be slidably moved to the left or to the right by supplying pilot fluid under pressure into one of pressure chambers *5b*, *5b*.

Figure 3:
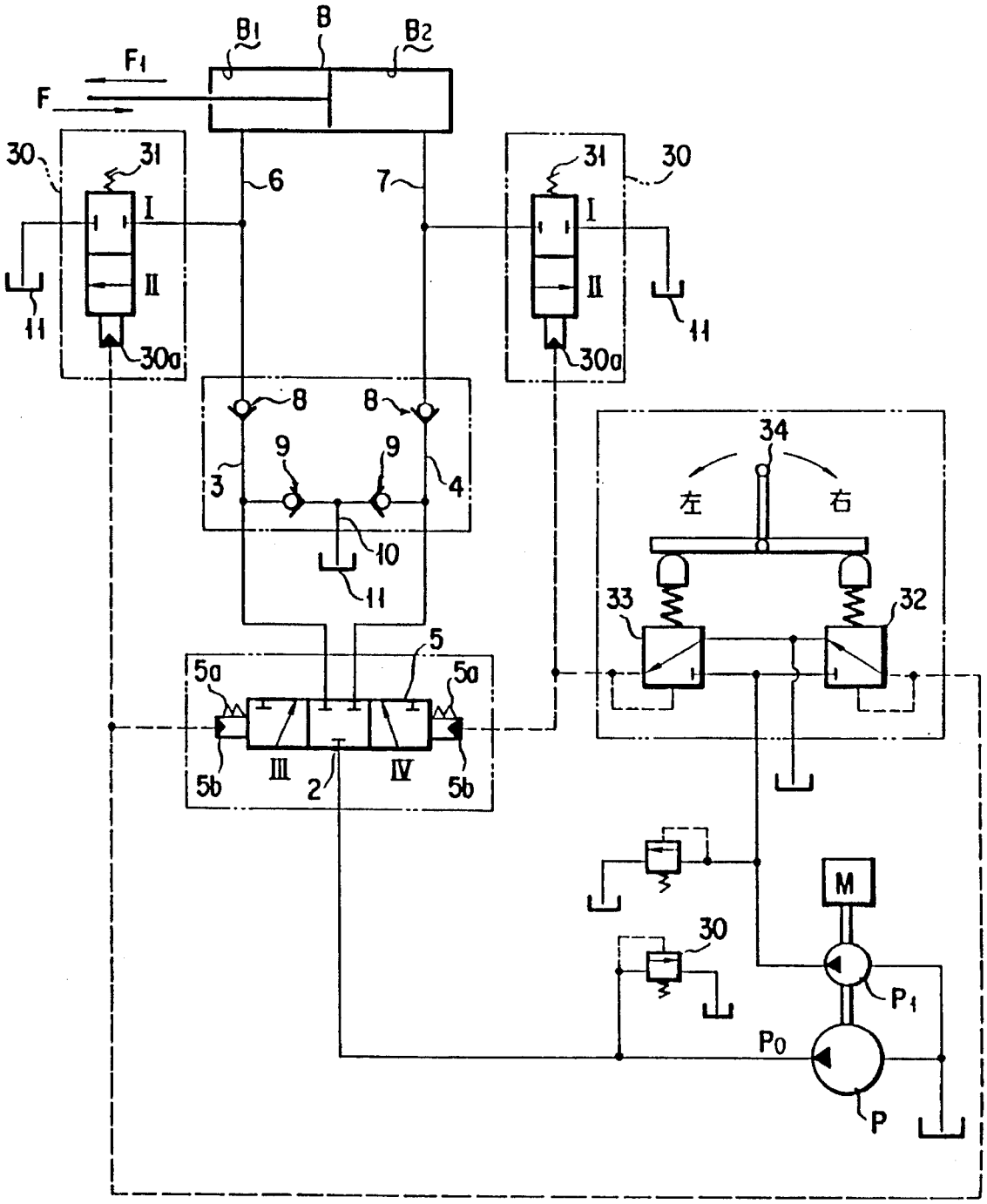
FIG. 3 is a circuit diagram showing the overall configuration of an example of application using the embodiment shown in FIG. 2.

FIG. 3 shows an example of application using the embodiment of the operating valve device shown in FIG. 2. The arrangement is made such that each of the first and second outlet ports 6, 7 associated with the first and second holes 3, 4, respectively, is controlled through a two-position, two-direction control valve 30 to be connected with or disconnected from a fluid tank 11. Each of the two-position, two-direction control valves 30 is normally held by a spring 31 at its disconnecting position I and changed over to its connecting position II when pilot fluid under pressure is supplied into its pressure chamber **30*a* so that the pressurized fluid discharged by a pilot pump $P_1$ may be supplied through a first pilot valve 32 and a second pilot valve 33, respectively, into the above-mentioned pressure chambers *5b* and 30*a***, respectively.

Such being the arrangement, when the first pilot valve 32 is changed over by means of a lever 34, pilot fluid under pressure is supplied into one of the pressure chambers *5b* of the main spool 5 and the pressure chamber **30*a* of one of the two position, two-direction control valves 30, respectively, so that the main spool 5 may assume its first position III where the inlet port 2 is allowed to communicate with the second hole 4, and also the two-position, two-direction control valve 30** may assume its connecting position II.

As a result, the fluid under pressure discharged by the pressurized fluid supply source P is supplied from the inlet port 2 into the second chamber $B_2$ of the actuator B through the second hole 4 and the second outlet port 7, whilst the pressurized fluid in the first chamber $B_1$ will flow into the fluid tank 11 through the first outlet port 6 and the two-position, two-direction control valve 30.

At that time, the fluid under pressure in the first chamber $B_1$ is prevented by a check valve 8 installed in the first hole 3 to flow out towards the side of the main spool 5, whilst the fluid under pressure flowing into the second hole 4 will open another check valve 8 and flow into the second outlet port 7.

Further, if, in the above-mentioned condition, the pressure loading F applied to the actuator B exceeds the value of actuator thrust F based on the pressure $P_0$ decided by the setting pressure of a main relief valve 35, then there is a risk of the fluid under pressure in the second chamber $B_2$ flowing back into the pressurized fluid supply source P through the second hole 4 and damaging the fluid supply source P. However, the check valve 8 installed in the second hole 4 will prevent fluid under pressure from flowing back into the pressurized fluid supply source P and damaging it.

Further, if the actuator B is moved by a pressure loading at a speed higher than the value corresponding to the amount of fluid under pressure supplied by the pressurized fluid supply source P, then the second chamber $B_2$ will form a vacuum. However, the fluid under pressure in the fluid tank 11 is drawn through a vacuum prevention valve 9 into the second chamber $B_2$ so as to replenish the latter fluid thereby preventing formation of a vacuum therein.

What is claimed is:

1. An operating valve device having an inlet port formed in the valve body thereof so as to communicate with a pressurized fluid supply source, a first outlet port and a second outlet port formed in the valve body so as to communicate with pressure chambers, respectively, defined on both sides of an actuator, a first hole and a second hole formed in the valve body at positions on both sides of said inlet port so as to allow said inlet port to communicate with said first and second outlet ports, respectively, and a tank port formed in the valve body between the first and second holes and communicating with a fluid tank, characterized in that it comprises a first communication hole and a second communication hole formed coaxially and in opposed relationship with each other so as to allow said first and second holes, respectively, to communicate with said tank port; a first valve hole and a second valve hole formed coaxially in the valve body outside and in succession with these communication holes, respectively; a pair of support shafts inserted in these valve holes, respectively, in opposed relationship with each other; vacuum prevention valve means each mounted on a leading end portion of each of the support shafts so as to open and shut each of said communication holes; and check valve means each mounted an the axially intermediate portion of each of said support shafts so as to prevent fluid under pressure from flowing through said first and second holes, respectively, into said inlet port.

2. An operating valve device comprising:

(a) an inlet port formed in the valve body thereof so as to extend from one end face thereof to a substantially intermediate position in a direction substantially at right angles to the one end face and communicating with a pressurized fluid supply source;

(b) a first hole and a second hole formed in the valve body on both sides of the inlet port and in substantially parallel relationship with each other;

(c) a valve hole formed in the valve body at right angles to the first and second holes and the inlet port so as to allow said first and second holes, respectively, to communicate with said inlet port;

(d) a main spool slidably mounted in said valve hole so as to allow either said first hole or said second hole to selectively communicate with said inlet port;

(e) a tank port formed in the valve body so as to extend from the other end face thereof to a substantially intermediate position in a direction at right angles to the other end face and communicating with a fluid tank;

(f) a first outlet port and a second outlet port formed in the valve body on both sides of the tank port and in substantially parallel relationship and outside said first and second holes, respectively, and connected with pressure chambers, respectively, defined on both sides of an actuator;

(g) a first communication hole and a second communication hole formed in the valve body at right angles to the first and second holes and the tank port and coaxially with each other to allow said first and second holes, respectively to communicate with said tank port;

(h) a first valve hole and a second valve hole formed in the valve body outside and coaxially with the first and second communication holes, respectively, so as to allow the first and second communication holes, respectively, to communicate with said first and second outlet ports, respectively;

(i) a pair of support shafts whose base portions being fixedly secured to the outer ends of said first and second valve holes, respectively, so as to be tightly fitted therein, the leading end portions of the support shafts extending into said first and second communication holes, respectively, and being located opposite to each other;

(j) check valves each having a valve body slidably mounted on an axially intermediate portion of each of said support shafts and held by a spring into pressure contact with a check valve seat; and (k) vacuum prevention valves each having a valve body slidably mounted on the axially leading end portion of each of said support shafts and held by a spring into pressure contact with a vacuum prevention valve seat.

* * * * *